US006966082B2

(12) United States Patent
Bloemer et al.

(10) Patent No.: US 6,966,082 B2
(45) Date of Patent: Nov. 22, 2005

(54) APPARATUS AND METHOD FOR RECIPROCATING AN INFANT SUPPORT

(75) Inventors: Kenneth Bloemer, Cincinnati, OH (US); Daniel Meiser, Butler, KY (US); Edward Westerkamp, West Chester, OH (US)

(73) Assignee: Bloemer, Meiser & Westerkemp, LLP, West Chester, OH (US)

( * ) Notice: Subject to any disclaimer, the term of this patent is extended or adjusted under 35 U.S.C. 154(b) by 0 days.

(21) Appl. No.: 10/700,611

(22) Filed: Nov. 4, 2003

(65) Prior Publication Data

US 2005/0091743 A1 May 5, 2005

(51) Int. Cl.[7] ..... A47D 9/00
(52) U.S. Cl. ..... 5/105; 5/655
(58) Field of Search ..... 5/108, 109, 102, 5/655, 105

(56) References Cited

U.S. PATENT DOCUMENTS

| | | | | |
|---|---|---|---|---|
| 1,261,400 | A | 4/1918 | Johnson | 5/104 |
| 2,869,145 | A | 1/1959 | Gregory | 5/109 |
| 2,916,745 | A | 12/1959 | Lesk et al. | 5/109 |
| 3,031,686 | A | 5/1962 | Muzzey | 5/109 |
| 3,040,342 | A | 6/1962 | Broers | 5/109 |
| 3,123,019 | A | 3/1964 | Blair | 108/21 |
| 3,261,033 | A | 7/1966 | Martin | 5/109 |
| 3,451,072 | A | 6/1969 | Cogdell | 5/109 |
| 3,529,311 | A | 9/1970 | Crawford | 5/109 |
| 3,570,023 | A | 3/1971 | Bennett | 5/109 |
| 3,885,787 | A | 5/1975 | Walker | 5/108 |
| 4,141,095 | A * | 2/1979 | Adachi | 5/108 |
| 4,620,334 | A | 11/1986 | Robinson | 5/108 |
| 4,656,680 | A | 4/1987 | Wilson | 5/108 |
| 4,681,096 | A | 7/1987 | Cuervo | 601/60 |
| 4,893,366 | A | 1/1990 | Rosen | 5/109 |
| 4,911,499 | A * | 3/1990 | Meeker | 297/260.2 |
| 4,969,451 | A | 11/1990 | Totten | 601/53 |
| 5,003,651 | A * | 4/1991 | Rosen | 5/109 |
| 5,107,555 | A | 4/1992 | Thrasher | 5/109 |
| 5,228,155 | A | 7/1993 | Shultz et al. | 5/109 |
| 5,342,113 | A * | 8/1994 | Wu | 297/260.2 |
| 5,617,594 | A * | 4/1997 | Chien | 5/102 |
| 5,694,655 | A * | 12/1997 | Shepler et al. | 5/105 |
| 5,708,994 | A * | 1/1998 | Chandran | 5/102 |
| 5,711,045 | A | 1/1998 | Caster et al. | 5/109 |
| 5,845,350 | A | 12/1998 | Beemiller et al. | 5/109 |
| 6,068,566 | A | 5/2000 | Kim | 474/84 |
| 6,378,940 | B1 | 4/2002 | Longoria et al. | 297/217.3 |
| 6,431,646 | B1 | 8/2002 | Longoria | 297/217.3 |
| 6,594,840 | B2 * | 7/2003 | Tomas et al. | 5/655 |
| 2002/0100116 | A1 | 8/2002 | Richards | 5/108 |

* cited by examiner

*Primary Examiner*—Thomas B. Will
*Assistant Examiner*—Tara L. Mayo

(57) ABSTRACT

An apparatus for reciprocating an infant support comprises a frame and a receiving member supported above the frame for substantially vertical reciprocating movement. The receiving member is configured to receive the infant support and, in one embodiment, is coupled to the frame by a reciprocating assembly configured to constrain the motion of the receiving member in a substantially vertical direction. A motive device coupled to the receiving member reciprocates the receiving member relative to the frame. The apparatus may also include a counterbalance mechanism configured to offset the load of the infant and the infant support on the motive device.

23 Claims, 10 Drawing Sheets

APPARATUS AND METHOD FOR RECIPROCATING AN INFANT SUPPORT

FIELD OF THE INVENTION

The present invention relates generally to devices for soothing infants, and more particularly to apparatus and methods of reciprocating an infant support.

BACKGROUND OF THE INVENTION

It is well known that agitated or crying infants, including infants which have been identified as exhibiting colicky symptoms, can often be soothed by rocking or bouncing. To alleviate the need for rocking and bouncing of an infant in the arms of a parent or other caretaker, many devices have been proposed to automatically bounce or rock infants to thereby sooth the infants and/or assist them in falling asleep. In general, these prior devices have been configured to provide rocking motion, or a combination of rocking and vertical bouncing motion.

While these prior devices have been beneficial, they have not always proved effective in soothing some infants. There is thus a need for an improved apparatus and method of soothing agitated infants which overcomes drawbacks of the prior art such as those discussed above.

SUMMARY OF THE INVENTION

Through experience and experimentation, the Applicants have determined that the most effective motion for soothing an agitated infant is achieved when the motion imparted to the infant is purely vertical, or at least substantially vertical. Moreover, it has been determined that the most effective soothing occurs over a particular range of vertical displacement and for a particular range of frequency of vertical reciprocation. Accordingly, the present invention provides an apparatus for reciprocating an infant in a substantially vertical direction.

In an exemplary embodiment, the apparatus comprises a frame and a receiving member configured to receive an infant support, such as an infant seat, a bassinet, or some type of infant carrier, thereupon. The receiving member is disposed above the frame and is movable in a substantially vertical direction. A motive device, which may be a motor, a spring-wound movement, or other device, is coupled to the receiving member and reciprocates the receiving member relative to the frame at a frequency between approximately 30 and 90 cycles per minute and with a vertical displacement of approximately 2 to 6 inches, measured between the uppermost and lowermost extremities of vertical travel.

In another exemplary embodiment, the apparatus further comprises a reciprocating assembly coupled between the frame and the receiving member. The reciprocating assembly is configured to constrain the motion of the receiving member such that it moves in a substantially vertical direction. In one preferred embodiment of the invention, the receiving member is a scissor mechanism.

In another aspect of the invention, the apparatus further comprises a counterbalance mechanism that cooperates with the motive device. The counterbalance mechanism is configured to offset the static and dynamic loads of an infant and an infant support carried by the apparatus, thereby providing a more uniform load on the motive device and facilitating smooth and efficient operation of the apparatus. In one exemplary embodiment, the motive device is a motor with a first crank connected between the motor output shaft and the receiving member for reciprocating the receiving member. The counterbalance mechanism comprises a second crank connected to the motor output shaft and coupled to the frame by a tension spring. The second crank is angularly offset from the first crank and the tension spring biases the second crank in a direction which complements the output torque of the motor output shaft when the receiving member is moved in an upward direction.

In another exemplary embodiment, the counterbalance mechanism comprises a gear train with a first gear coupled to the output shaft of the motor and a second gear coupled to the frame by a tension spring. In yet another exemplary embodiment, the counterbalance mechanism comprises a bell crank having a first crank arm coupled to the frame by a tension spring and a second crank arm coupled to the receiving member.

In yet another aspect of the invention, a method of soothing an infant comprises the steps of placing the infant on an infant support and vertically reciprocating the infant support at a frequency of approximately 30 to 90 cycles per minute at a total displacement, per cycle, of approximately 2 to 6 inches peak-to-peak.

These and other features, advantages, and objectives of the invention will become more readily apparent to those of ordinary skill in the art upon review of the following detailed description of the exemplary embodiments, taken in conjunction with the accompanying drawings.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the invention in sufficient detail to enable one of ordinary skill in the art to which the invention pertains to make and use the invention.

DETAILED DESCRIPTION

Figure 1:
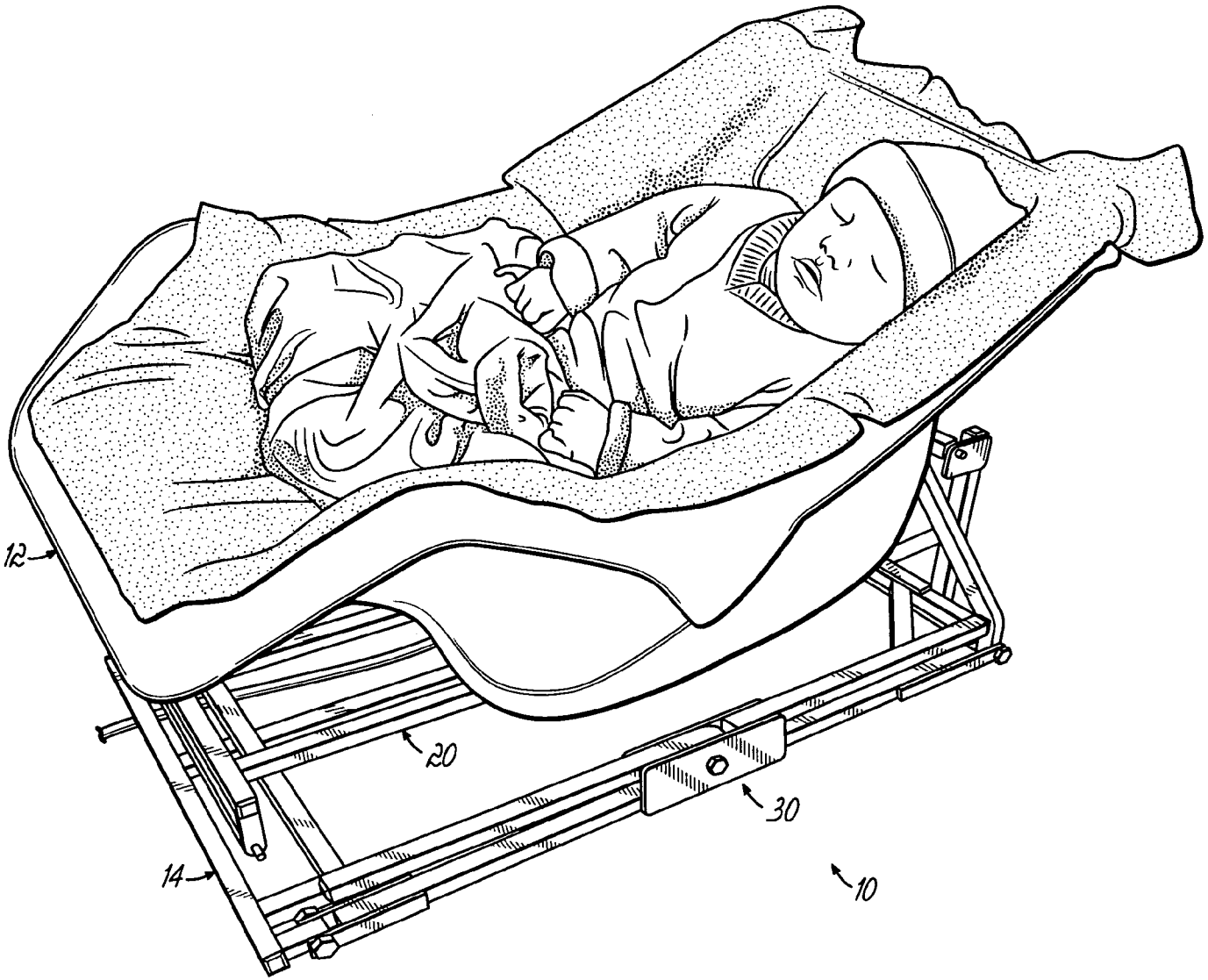
FIG. 1 is a perspective view depicting an exemplary apparatus for reciprocating an infant support according to the present invention.
Figure 2:
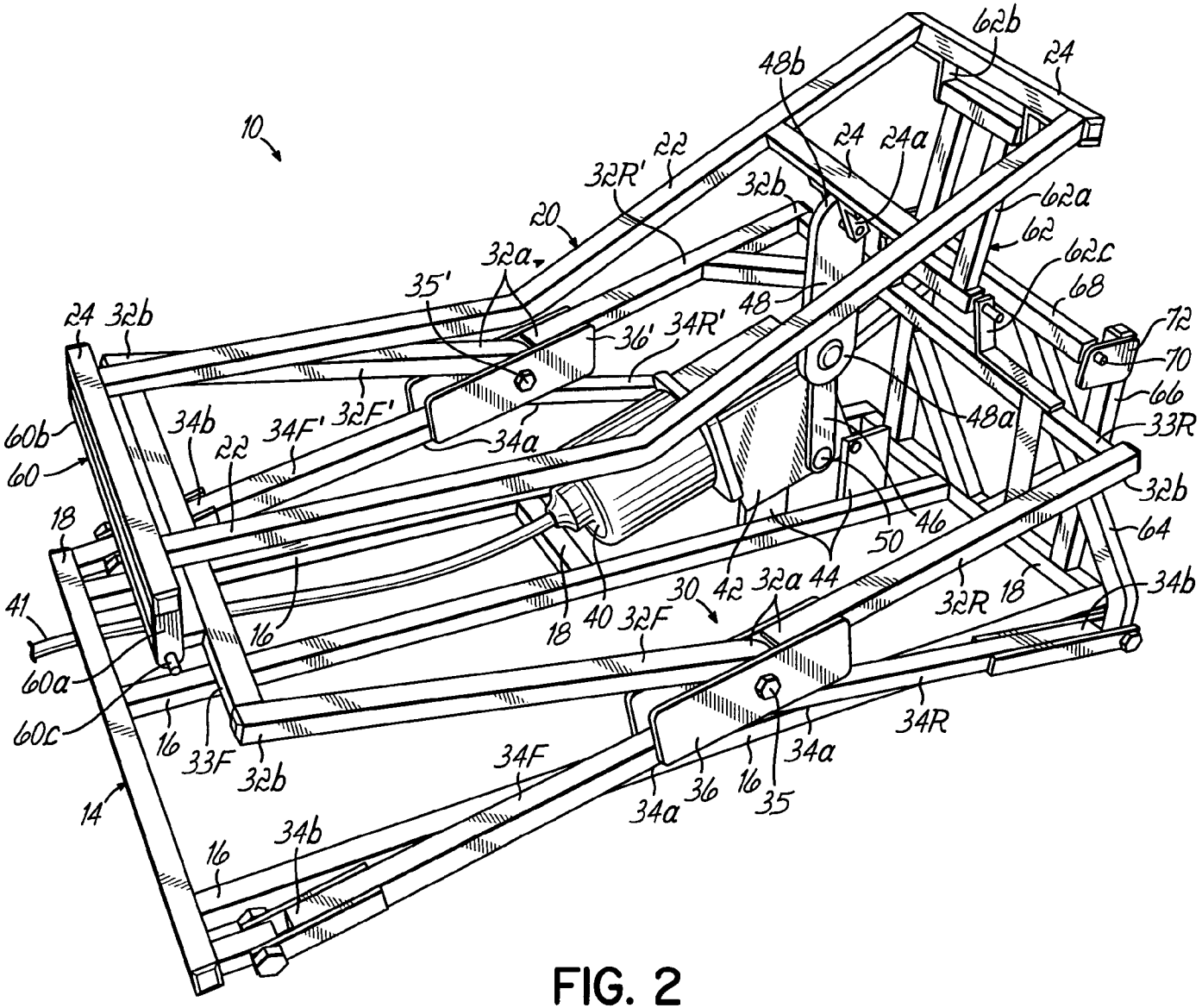
FIG. 2 is a perspective view of the apparatus of FIG. 1, with the infant support removed to show detail.
Figure 3:
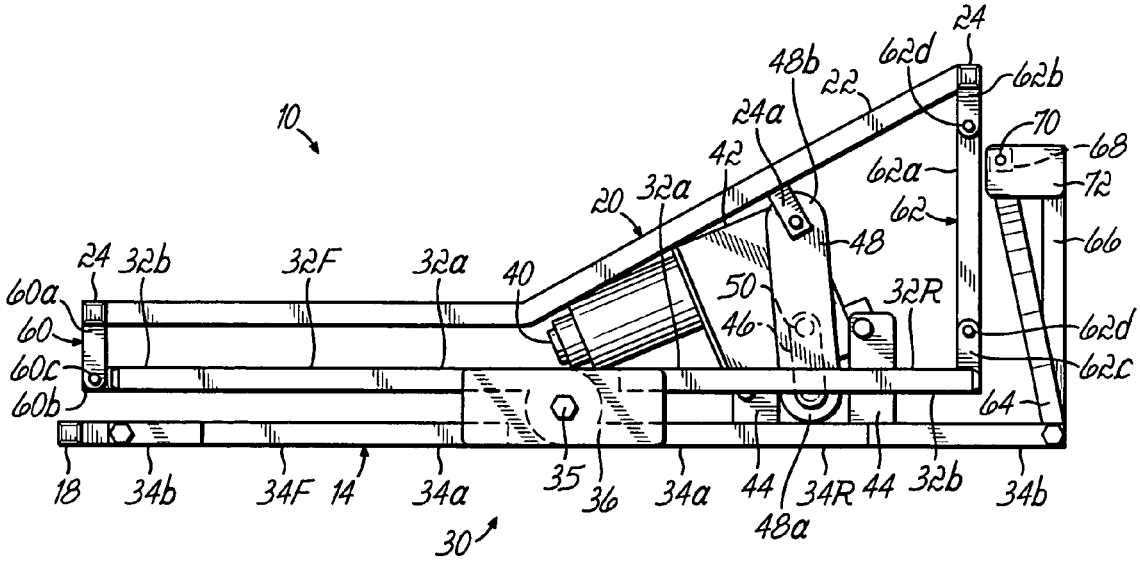
FIG. 3 is a side elevation of the apparatus of FIG. 1, shown in a retracted position.
Figure 4:
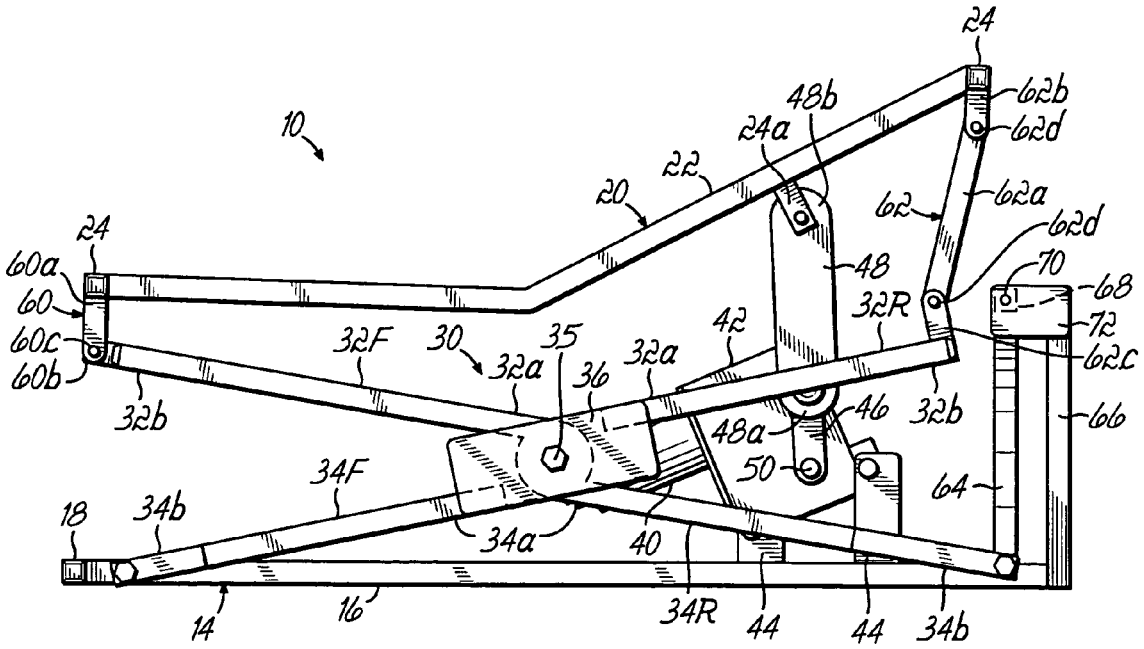
FIG. 4 is a side elevation, similar to FIG. 3, depicting the apparatus in an extended position.

Referring to FIG. 1, there is shown an exemplary apparatus 10 for reciprocating an infant support 12, according to the present invention. FIGS. 2–4 depict the apparatus 10 of FIG. 1 with the infant support 12 removed. The apparatus 10 includes a stationary frame 14 which serves as a base for the apparatus 10. In the exemplary embodiment shown, the frame 14 comprises longitudinally-extending, elongate, tubular members 16 and transverse crossmembers 18 which have been joined to create a stable, rectangular base for supporting the other components of the infant support reciprocating apparatus 10.

A receiving member 20 is supported above the frame 14 and comprises a pair of longitudinally-extending, tubular members 22 and three transverse crossmembers 24 joined together to form a platform upon which the infant support 12 may be placed. The receiving member 20 is coupled to the frame 14 by a reciprocating assembly or mechanism 30 that is configured to constrain movement of the receiving member 20 in a substantially vertical direction. While pure vertical motion is desirable, it is recognized that there may be some play between the various connected members of the apparatus due to manufacturing tolerances, and that physical and cost constraints may render pure vertical motion impractical. Accordingly, "substantially vertical motion", as used herein, shall mean motion in a vertical direction with no more than approximately 7% horizontal motion.

While the frame 14, receiving member 20, and reciprocating assembly 30 are depicted in the exemplary embodiments as structures formed from tubular members interconnected in any suitable manner, such as by welding, it will be recognized that these components may be formed by other fabrication methods, such as by molding, stamping, etc., and may be formed in other configurations to provide a stable base, a platform for receiving an infant, and a mechanism for constraining motion of the apparatus.

In the exemplary embodiment shown, the reciprocating assembly 30 comprises a scissor mechanism attached between the frame 14 and the receiving member 20 of the apparatus 10. As shown most clearly in FIGS. 2–4, the scissor mechanism 30 comprises a pair of spaced-apart, parallel front upper arms 32F, 32F' and a pair of spaced-apart, parallel rear upper arms 32R, 32R'. The outer ends 32*b* of the front upper arms 32F, 32F' and the rear upper arms 32R, 32R' are rigidly interconnected by front and rear horizontal bars 33F, 33R extending transversely between the respective outer ends 32*b*. The scissor mechanism 30 further comprises a pair of spaced-apart, parallel front lower arms 34F, 34F' and a pair of spaced-apart, parallel rear lower arms 34R, 34R' positioned beneath the respective front and rear upper arms 32F, 32F', 32R, 32R'.

The front lower arms 34F, 34F' and the rear upper arms 32R, 32R' are rigidly fixed at their respective inner ends 34*a*, 32*a* to coupling plates 36, 36' located on opposite sides of the scissor mechanism 30, such as by welding. The front upper arms 32F, 32F' and the rear lower arms 34R, 34R' are rigidly fixed to one another and pivotally secured at their respective inner ends 32*a*, 34*a* to the respective coupling plates 36, 36' by horizontal pivot pins 35, 35' rigidly connected to the coupling plates 36, 36'. The outer ends 34*b* of the front and rear lower arms 34F, 34F', 34R, 34R' are pivotally coupled to the frame and the horizontal bars 33F, 33R are pivotally coupled to the receiving member 20, as described in more detail below, such that when the receiving member 20 is displaced in a vertically upward direction, upper and lower scissor arms 32F, 32F', 32R, 32R', 34F, 34F', 34R, 34R' move in crossed fashion relative to pivot pins 35, 35' such that the scissor mechanism 30 extends between the frame 14 and the upwardly displaced receiving member 20, as depicted in FIGS. 3 and 4. Advantageously, scissor mechanism 30 constrains the movement of the receiving member 20 relative to the frame 14 such that the infant support 12 moves in a substantially vertically direction, while reducing the amount of relative motion at the pin joints (e.g., 35, 35', 60*c*, 62*d*, 70) thereby reducing wear and prolonging the life of the apparatus 10.

A motor 40 and gearbox 42 are secured to the frame 14 by motor support brackets 44 and are coupled to the receiving member 20 by a first crank 46. The first crank 46 is rigidly secured at one end to the output shaft 50 of the gearbox 42, and is pivotally connected at its other end to the lower end 48*a* of a connecting link 48. The upper end 48*b* of connecting link 48 is in turn pivotally coupled to a bracket 24*a* rigidly connected to a crossmember 24 of the receiving member 20, whereby rotation of the output shaft 50 of the gearbox 42 imparts vertical reciprocating motion to the receiving member 20 through first the crank 46 and the connecting link 48.

In a preferred embodiment, a relatively high-speed, low torque motor 40 is used with a reduction gearbox 42 whereby the motor output is converted to a low-speed, high-torque output from the gearbox 42. Alternatively, the output shaft 50 may be provided directly from a low-speed, high-torque motor 40, without a gearbox 42. The motor 40 shown in the figures is electrically connected to a power supply (not shown), such as a DC power supply or an AC outlet, by a power cord 41. Alternatively, motor 40 may be electrically connected to a battery. In another exemplary embodiment, the apparatus 10 is configured such that motor 40 may be electrically connected to an accessory power outlet of an automobile, such as a cigarette lighter socket.

As the receiving member 20 is moved by the motor 40 and gearbox 42, the scissor mechanism 30 constrains the receiving member 20 to move in a substantially vertical direction, as illustrated in FIGS. 3 and 4. To accommodate the corresponding longitudinal contraction of the scissor mechanism 30 as it is extended to move the receiving member 20 in an upward direction, the upper scissor arms 32F, 32F', 32R, 32R' are coupled to the receiving member 20 by front and rear swing members 60, 62 located at the distal ends of the receiving member 20, and the lower rear scissor arms 34R, 34R' are pivotally coupled to the frame 14 by scissor support arms 64.

The front swing member 60 comprises first and second swing links 60*a*, 60*b* rigidly coupled to the frontmost crossmember 24 of the receiving member 20 and the front horizontal bar 33F, respectively. The first and second swing links 60*a*, 60*b* are pivotally connected by a pin 60*c* to accommodate rotational movement of the front upper scissor arms 32F, 32F', relative to receiving member 20, as receiving member 20 is moved in the vertical direction. The rear swing member 62 comprises pairs of parallel spaced tubular members joined together to form a rectangular link 62*a*. An upper end of the link 62*a* is pivotally connected to the rearmost crossmember 24 of the receiving member 20 and the lower end of link 62*a* is pivotally connected to the rear horizontal member 33R by respective brackets 62*b*, 62*c* and pins 62*d*, whereby link 62*a* rotates about the pins 62*d* to accommodate the relative motion between the rear upper scissor arms 32R, 32R' and the receiving member 20.

The scissor support arms 64 are coupled to a pair of spaced vertical posts 66 of the frame 14 by a transverse pivot member 68 extending between the upper ends of the posts 66. The support arms 64 are angled inwardly from the sides of the apparatus 10 and are rigidly joined to the pivot member 68. Pivot member 68 is pivotally coupled to the vertical posts 66 by pins 70 disposed on the distal ends of the pivot member 68 and extending through brackets 72 rigidly connected to the upper ends of vertical posts 66.

While the reciprocating assembly 30 has been shown and described herein as a scissor mechanism, it will be recognized that various other mechanisms could alternatively be used to constrain movement of the receiving member 20 relative to frame 14 to be in a substantially vertical direction. For example, various types of mechanisms which could be used in this fashion are shown and described in "Mechanisms and Mechanical Devices Sourcebook," Third Ed., Neil Sclater and Nicholas P. Chironis, 2001; and in "Ingenious Mechanisms for Designers and Inventors," vols. I–III, Franklin D. Jones and Holbrook L. Horton, 1930, 1936, 1951, incorporated by reference herein in their entirety.

In use, the pinned connections between the frame 14, the scissor mechanism 30, and the receiving member 20 allow the receiving member 20 to reciprocate up and down while constrained by the scissor mechanism 30 to move in a substantially vertical direction when the first crank arm 46 rotates between a downward extending position, as depicted in FIG. 3, to an upward extending position, as depicted in FIG. 4. Advantageously, an infant support 12, such as a an infant seat, a bassinet or other suitable support, may be placed on the receiving member 20 when soothing of the infant is desired, and the motor 40 energized to move the receiving member 20 as described above, whereby the infant support 12 will be reciprocated in a substantially vertical direction. Alternatively, the receiving member 20 may be configured to support an infant placed directly thereon, without the need for an infant support 12 or other intermediate device.

In an exemplary embodiment, the apparatus 10 is configured to reciprocate the receiving member 20 with a vertical displacement of approximately 2–6 inches, and the motor 40 is controlled to reciprocate the receiving member 20 at a frequency of approximately 30–90 cycles per minute. In another exemplary embodiment, the apparatus 10 is configured to reciprocate the receiving member 20 with a displacement of approximately 3–5 inches. In another exemplary embodiment, the apparatus 10 is configured to reciprocate the receiving member 20 with a displacement of approximately 4 inches. In another exemplary embodiment, the motor 40 is operated to reciprocate the receiving member 20 at a frequency of approximately 30 cycles per minute to 60 cycles per minute. In another exemplary embodiment, the motor 40 is operated to reciprocate the receiving member 20 at a frequency of approximately 35 to 70 cycles per minute. In yet another exemplary embodiment, the motor 40 is operated to reciprocate the receiving member 20 at a frequency of approximately 40–90 cycles per minute.

While the motive device illustrated and described above with respect to FIGS. 1–4 is an electric motor 40, it will be recognized that other motive devices may be utilized to impart motion to the receiving member 20, such as spring-wound movements, pneumatic and hydraulic cylinders, or other devices suitable for imparting motion to the receiving member 20.

Figure 5:
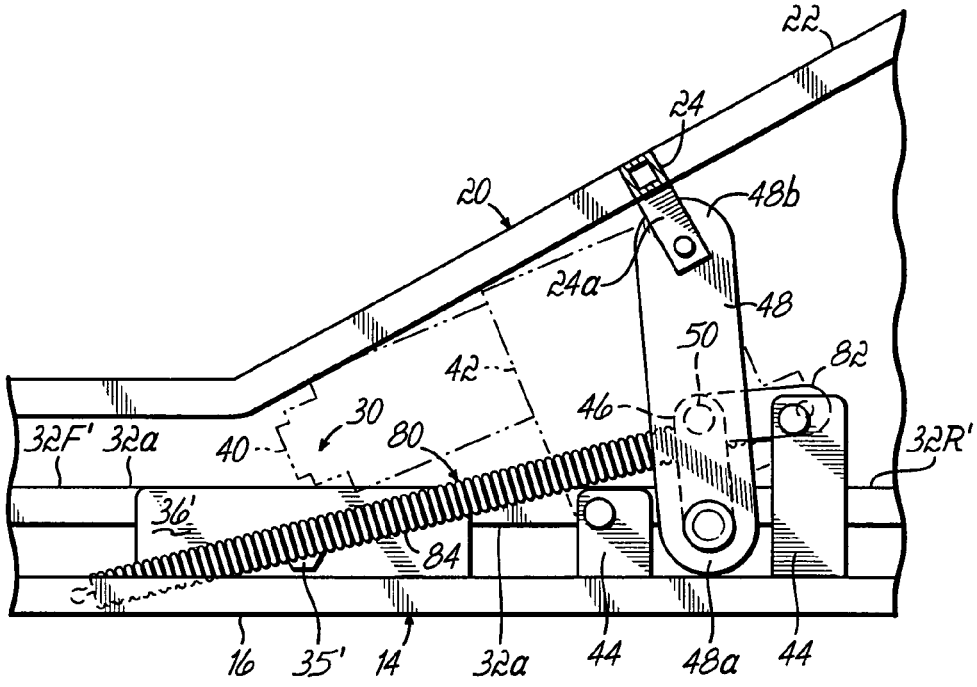
FIG. 5 is a detailed elevation view, similar to FIG. 3, illustrating an alternative embodiment of the present invention with some components removed for clarity.
Figure 6:
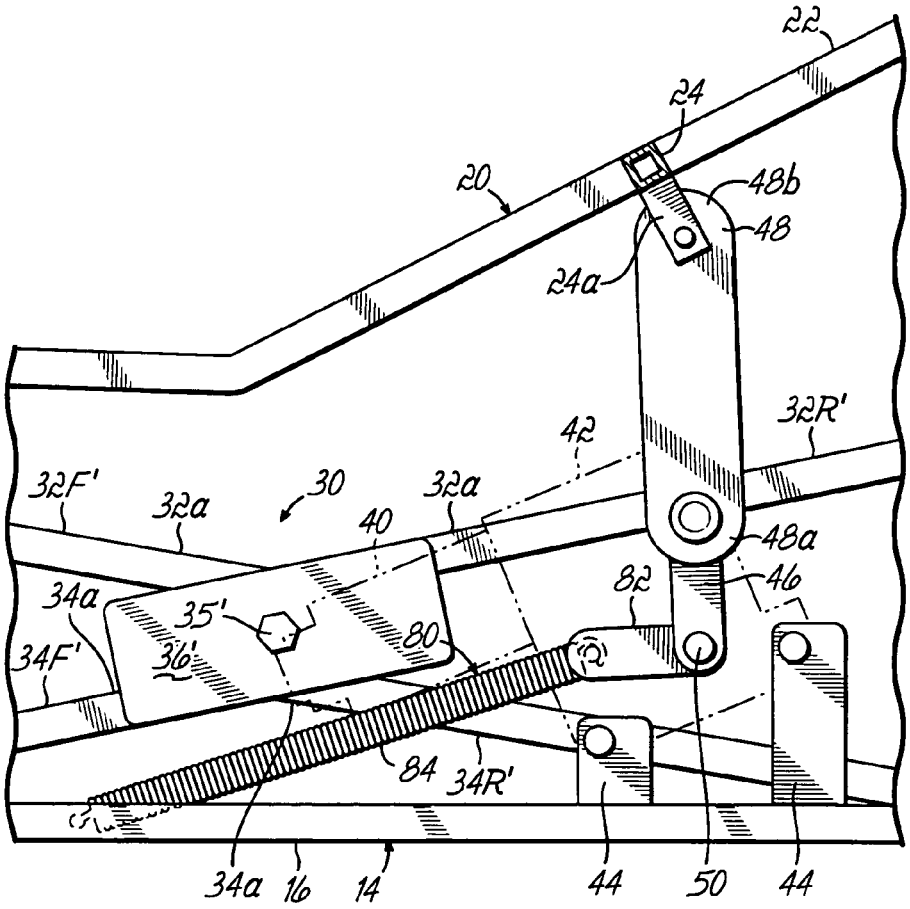
FIG. 6 is a detailed elevation view depicting the embodiment of FIG. 5 in an extended position.

In another exemplary embodiment, the infant reciprocating apparatus 10 further includes a counterbalance mechanism that cooperates with the motor 40 and gearbox 42 to offset the static and dynamic loads of an infant and an infant support 12 carried on the receiving member 20 to thereby ensure a uniform load on the motor 12 and to provide efficient and smooth operation of the device. With reference to FIGS. 5 and 6, there is shown an exemplary counterbalance mechanism 80 comprising a second crank 82 coupled at one end to the output shaft 50 of the gearbox 42 and a biasing member, such as a tension spring 84, having one end secured to the frame 14 and another end coupled to the other end of the second crank 82. This can be accomplished by selecting a motor or gearbox with dual output shafts sharing the same axis and locating first crank 46 on one side of motor 40 and second crank 82 on the opposite side of motor 40. When the second crank 82 is in a position which is angularly offset from the first crank 46, the tension spring 84 biases the second crank 82 in a manner that facilitates raising the receiving member 20 to the extended position, as depicted in FIG. 6. Advantageously, the spring force of the tension spring 84 and the angular position of the second crank 82 with respect to the first crank 46 may be selected to counterbalance the static and dynamic loads of an infant and an infant support 12 on the apparatus 10 to thereby provide a more uniform load on the motor 40.

Figure 6A:
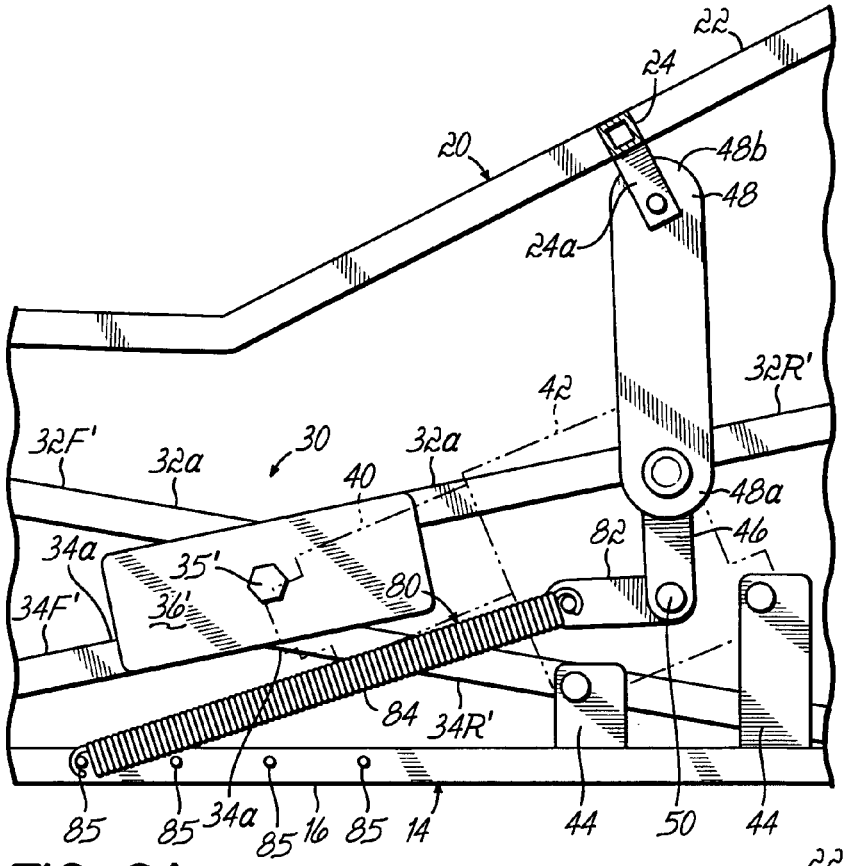
FIG. 6A is an alternate embodiment of the apparatus of FIG. 6.
Figure 6B:
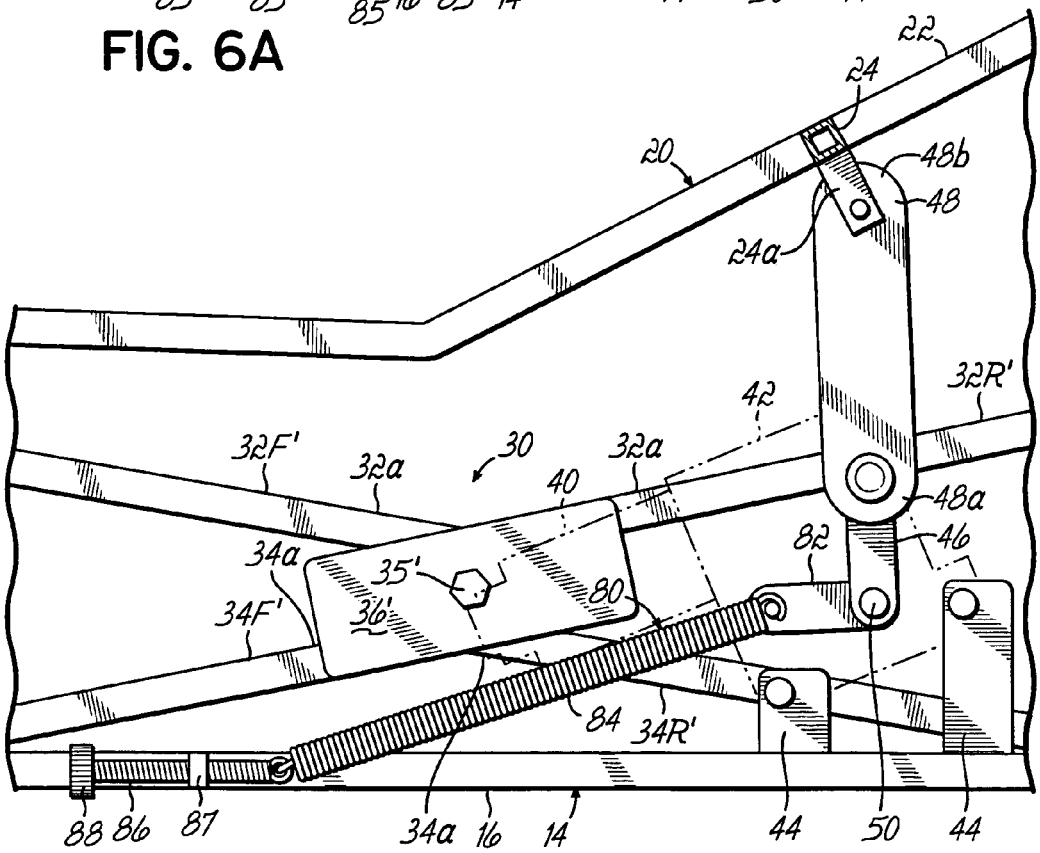
FIG. 6B is another alternate embodiment of the apparatus depicted in FIG. 6.

The spring force of the tension spring 84 may be adjusted, for example, by removing spring 84 and replacing it with a different spring having a different spring force selected to offset the static and dynamic loads of an infant and the infant support 12. Alternatively, the apparatus 10 may be configured to facilitate adjustment of the spring force without removing spring 84. In one embodiment, the spring 84 is selectively attached at various positions on frame 14 by securing spring 84 to one of several pins 85, as depicted in FIG. 6A, wherein each position provides a different preload to spring 84 to thereby vary the spring force. In another embodiment, depicted in FIG. 6B, spring 84 is adjustably secured to the end of a threaded rod 86. The rod 86 is in turn threadably coupled to frame 14 by a welded nut 87 for movement to various positions which correspond to different extended lengths of spring 84 to thereby vary the amount of preload on spring 84. Threaded rod 86 is provided with a handle 88, disposed on an end of the rod 88 opposite the spring 84, to facilitate manual adjustment of the rod 86.

Figure 7:
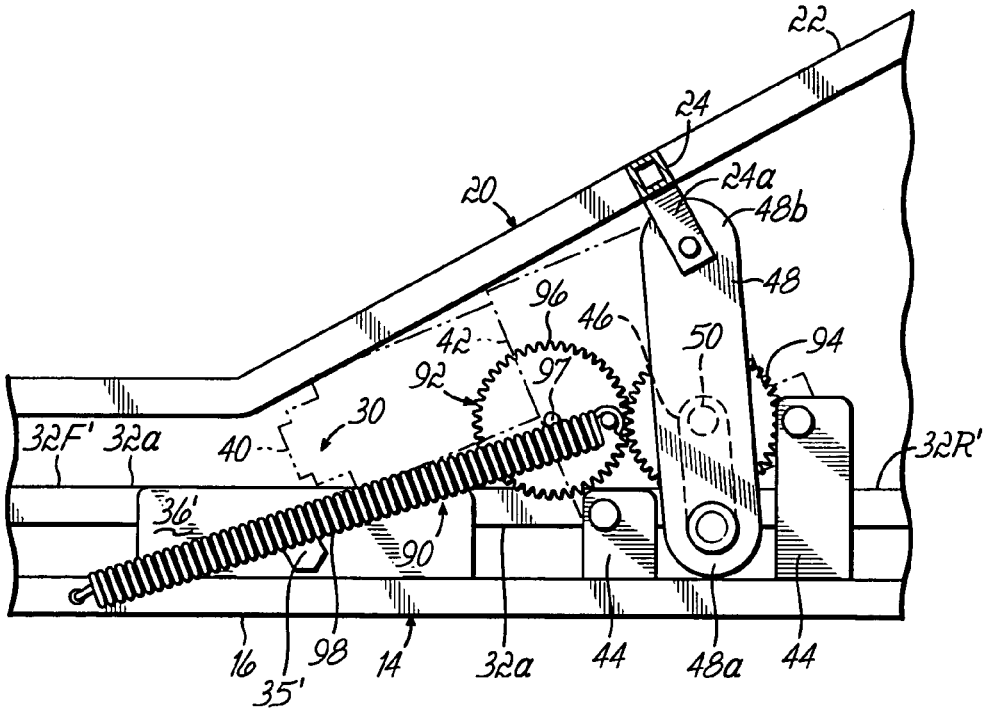
FIG. 7 is a detailed elevation view, similar to FIG. 5, illustrating another exemplary embodiment of the apparatus of the present invention.
Figure 8:
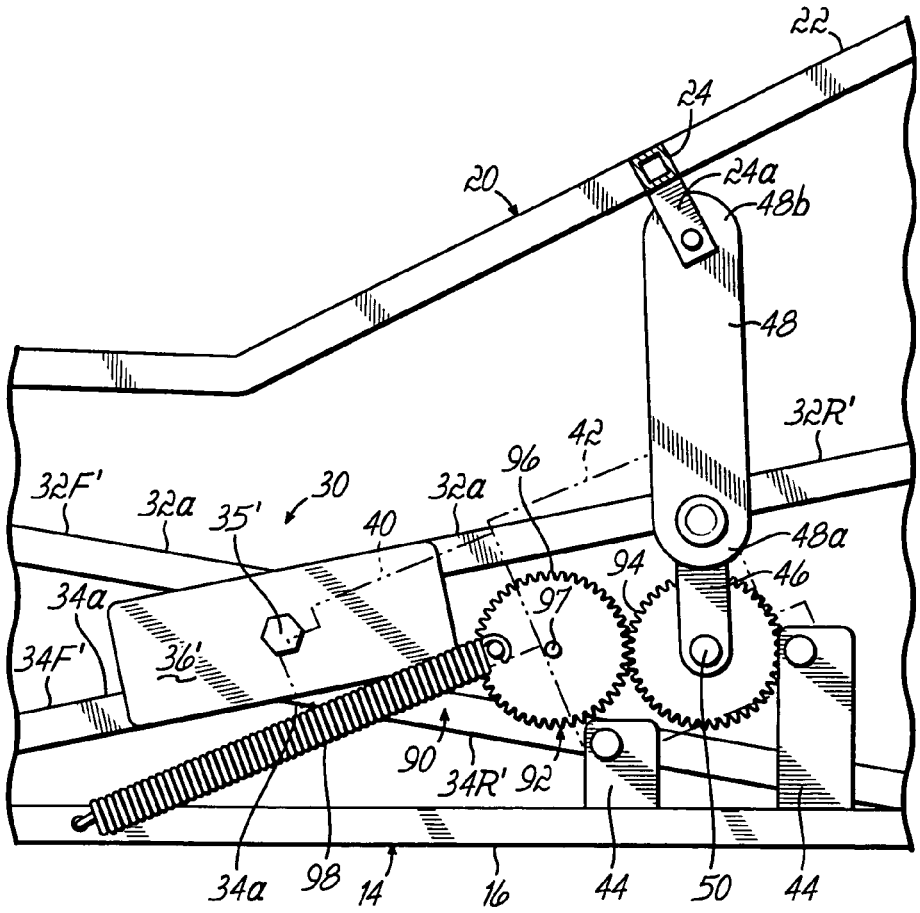
FIG. 8 is a detailed elevation view depicting the embodiment of FIG. 7 in an extended position.

Referring now to FIGS. 7 and 8, there is shown another exemplary embodiment of a counterbalance mechanism 90, for providing a more uniform load on the motor 40. In FIGS. 7 and 8, the counterbalance mechanism 90 comprises a gear train 92 coupled to the output shaft 50 of the gearbox 42 and to a biasing member which facilitates movement of the receiving member 42 from a retracted position, as shown in FIG. 7, to an extended position, as shown in FIG. 8. In the exemplary embodiment shown, the gear train 92 comprises a first gear 94 coupled to the output shaft 50 of the gearbox 42. A second gear 96 is rotatably secured to the frame 14 by a pin 97 extending from a support bracket (not shown). The second gear 96 meshes with the first gear 94 and is coupled to a tension spring 98 secured at one end to the frame 14. The tension spring 98 is coupled to the second gear 96 in an eccentric fashion, that is, at a point disposed radially outwardly of the center of rotation of the second gear 96, whereby the spring force and the relative positions between the eccentric connection and the first crank arm 46 may be selected to provide sufficient additional torque on output shaft 50 to counterbalance the static and dynamic loads of an infant and an infant support 12 placed upon the receiving member 20. It will be recognized that the spring force in tension spring 98 may be adjusted to accommodate various static and dynamic loads, as discussed above with respect to FIGS. 6, 6A and 6B.

Figure 9:
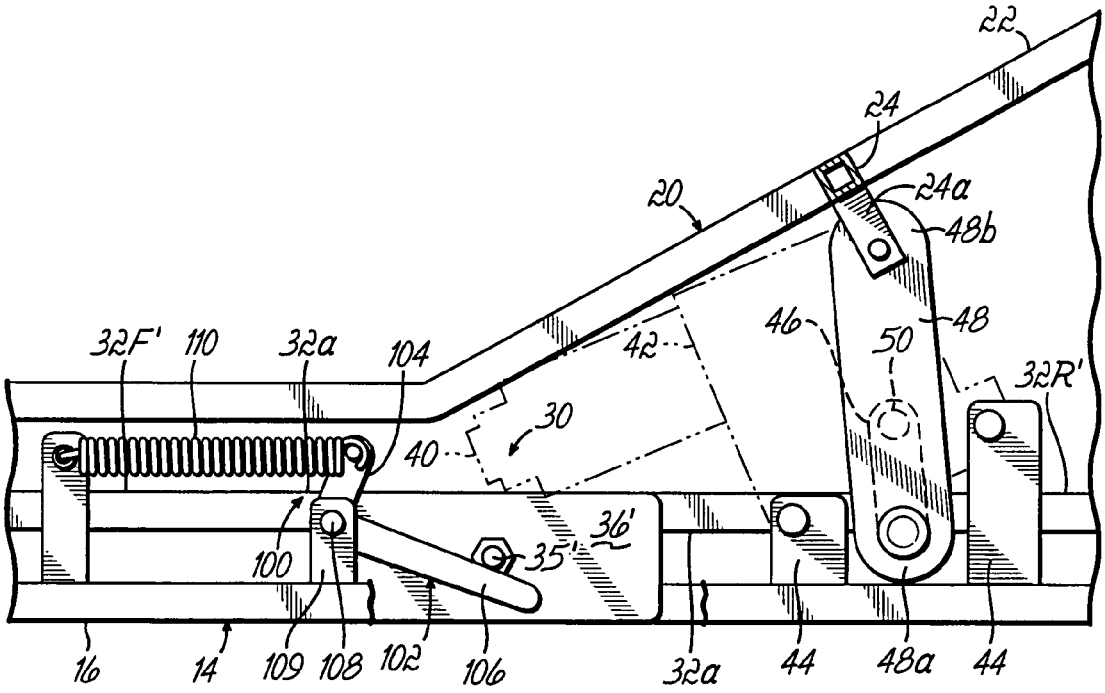
FIG. 9 is a detailed elevation view, similar to FIG. 5, depicting yet another exemplary embodiment of the present invention.
Figure 10:
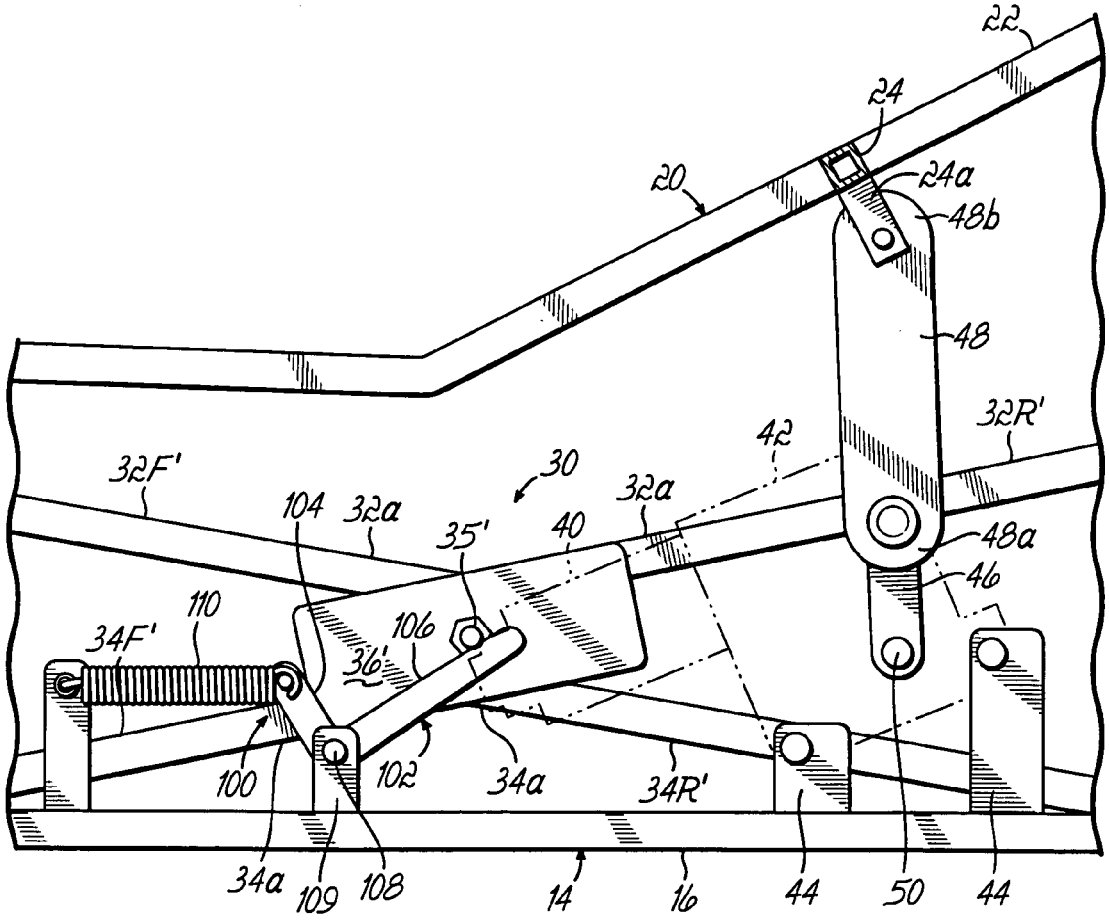
FIG. 10 is a detailed elevation view of the exemplary embodiment of FIG. 9, shown in an extended position.

Referring now to FIGS. 9 and 10, there is shown yet another exemplary embodiment of a counterbalance mechanism 100 for use with the infant reciprocating apparatus 10 of the present invention. In this embodiment, the counterbalance mechanism 100 comprises a bell crank 102 pinned at 108 to the upper end of a stationary mounting bracket 109 rigidly mounted to the frame 14. The bell crank 102 has first and second crank arms 104 and 106. The second crank arm 106 engages the reciprocating assembly 30, by sliding contact with pin 35 extending through coupling plate 36, to facilitate raising the receiving member 20 from the retracted position to the extended position when the bell crank 102 is biased to pivot about the pinned joint 108. While the second crank arm 106 has been shown and described herein as engaging the reciprocating assembly 30 to facilitate raising receiving member 20, it will be recognized that second crank arm 106 may alternatively be coupled to receiving member 20 in various other ways to facilitate raising the receiving member 20.

In the exemplary embodiment shown, a tension spring 110 has its opposite ends coupled between the frame 14 and the first arm 104 of the bell crank 102 whereby the tension spring 110 biases the bell crank 102 in a counterclockwise direction (as viewed in FIGS. 9–10) which upwardly biases the receiving member 20 and facilitates raising the receiving member 20 to the extended position. Advantageously, the spring force of the tension spring 110 and the configuration of the bell crank 102 may be selected to cooperate with the first crank 46 to counterbalance the static and dynamic loads of an infant and an infant support 12 carried by the receiving member 20. Specifically, the tension spring may be selected to provide an upward force on pin 35, leveraged by the lengths of the first and second crank arms 104, 106 pivoting about pinned joint 108, which is substantially equal to the static and dynamic loads of an infant and an infant support 12 carried by the receiving member 20. It will be recognized that the spring force of tension spring 110 can be adjusted, for example, in the manner described above with respect to FIGS. 6, 6A and 6B.

Figure 11:
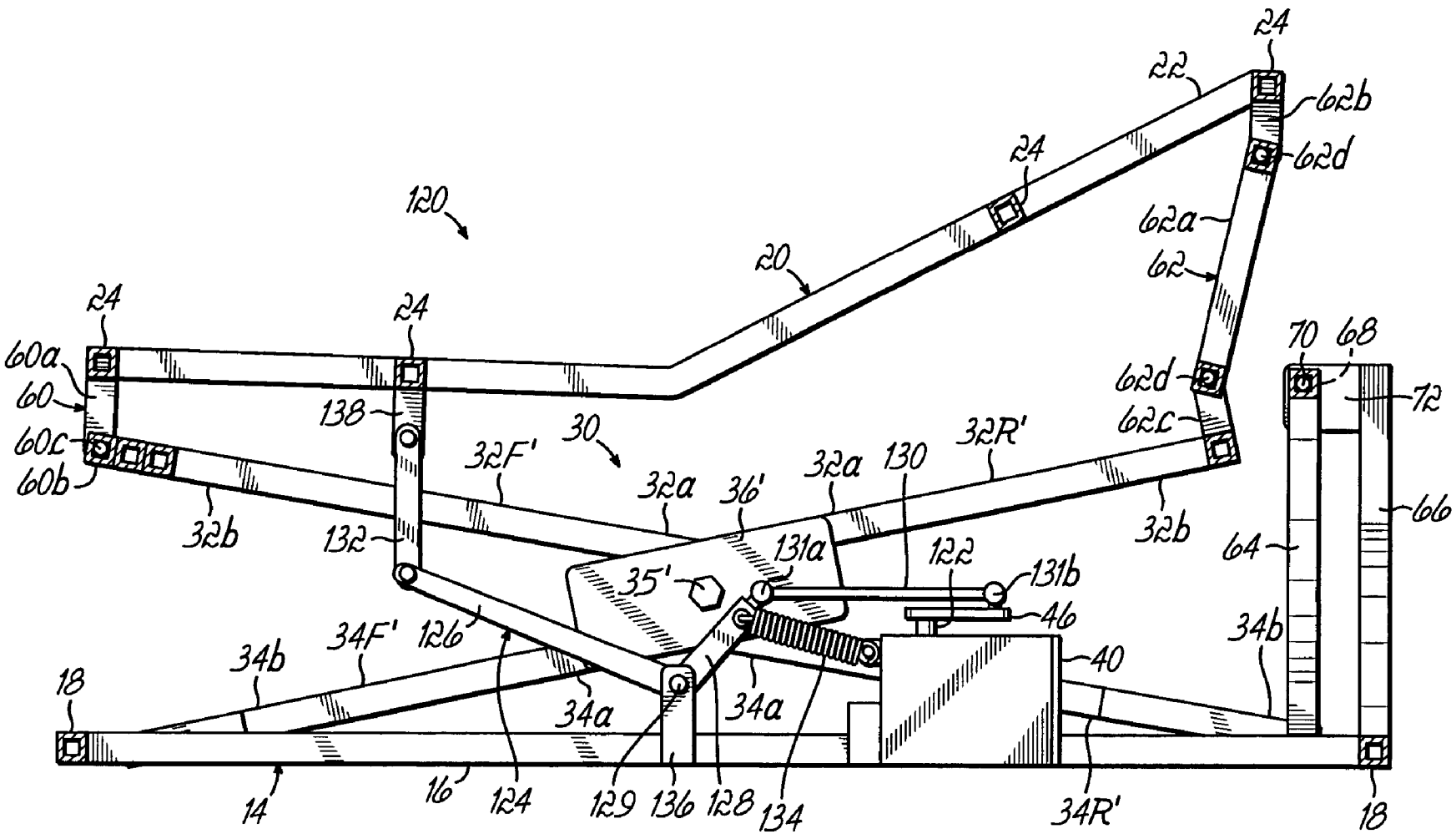
FIG. 11 is a side elevation depicting yet another exemplary apparatus for reciprocating an infant support, in accordance with the present invention.

Referring to FIG. 11, there is shown yet another exemplary apparatus 120 for reciprocating an infant support 12, wherein components with like numbers correspond to like-numbered components in the previous figures. In this exemplary embodiment, the motive device comprises a motor 40 having an output shaft 122 oriented with its longitudinal axis extending substantially in a vertically upward direction. The output shaft 122 may be provided directly from the motor 40, or the motive device may include a gearbox as shown and described above, in which event output shaft 122 would be the output of a reduction gearbox. In an exemplary embodiment, the motive device includes a gearbox with a worm gear for efficiently transforming the relatively higher speed and low torque of the motor to a relatively higher output torque at a lower speed. The first crank 46 is coupled to the receiving member 20 by a linkage comprising a bell crank 124 having first and second crank arms 126, 128. The bell crank 124 is pivotally coupled to the frame via a horizontal pin 129 anchored to the upper end of a vertical bracket 136, the lower end of which is rigidly secured to the frame 14. The outer end of second crank arm 128 is coupled to the outer end of the first crank 46 by a connecting rod 130 having ball joints 131*a*, 131*b* disposed on its distal ends. The first crank arm 126 of the bell crank 124 is coupled at its outer end to the receiving member by an intermediate link 132 which is pinned at its opposite ends to bell crank arm 126 and the lower end of a bracket 138 which extends downwardly from a crossmember 24 of the receiving member 20.

In operation, the first crank 46 is rotated about output shaft 122 by motor 40 to pivot bell crank 124 and thereby cause the receiving member 20 to reciprocate in a substantially vertical direction. A tension spring 134 connected between the second crank arm 128 and the frame 14 biases the bell crank 124 in a direction that raises the receiving member 20 toward the extended position. Accordingly, the spring force of the tension spring 134 and the relative positions of the bell crank 124 and first crank 46 may be selected to offset the static and dynamic loads of an infant and an infant support 12 placed on the receiving member 20. For example, the spring force in spring 134 may be adjusted as described above with respect to FIGS. 6, 6A and 6B.

Figure 12:
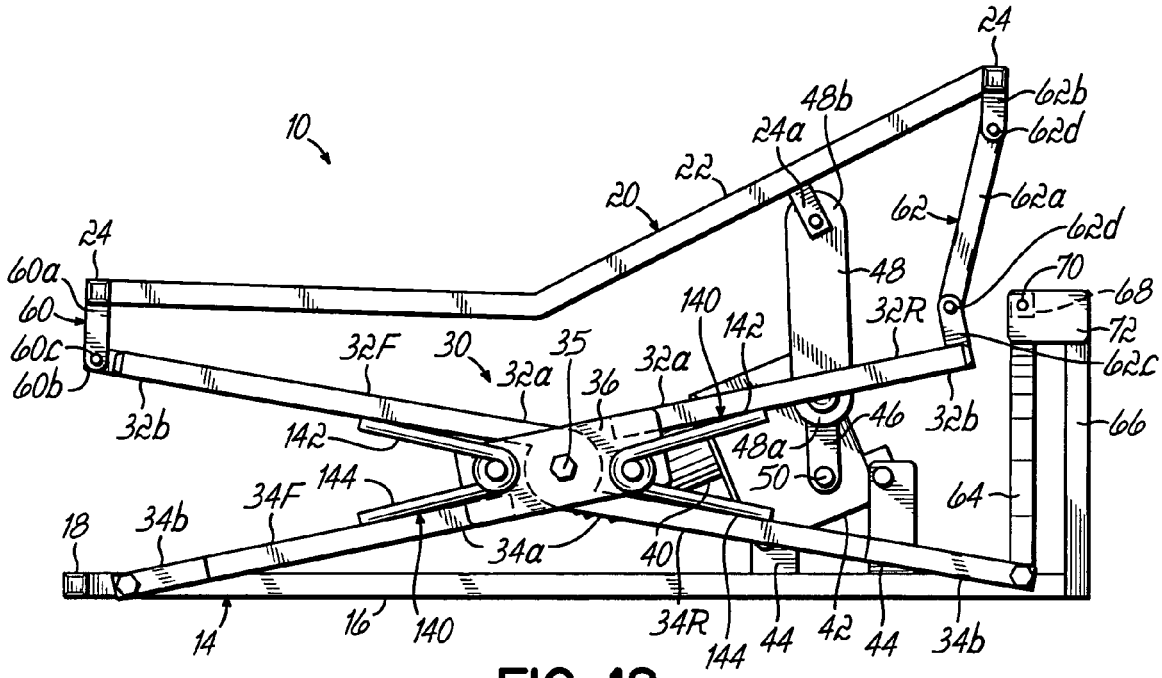
FIG. 12 is a side elevation depicting an alternate embodiment of the apparatus of FIG. 4.

While the biasing members of the counterbalance mechanisms 80, 90, 100 have been shown and described herein as tension springs 84, 98, 110, it will be recognized that other types of biasing members may alternatively be used, such as compression springs, elastomeric members, torsion springs, constant force springs, pneumatic devices, or any other device which could be used to offset the static and dynamic loads of an infant and an infant support 12 on the apparatus 10. For example, FIG. 12 depicts the apparatus of FIG. 4 wherein torsion springs 140 are coupled between the upper arms 32F, 32R, 32F', 32R' and lower arms 34F 34R, 34F', 34R' of scissor mechanism 30 to offset the static and dynamic loads of an infant and an infant support 12. In this embodiment, the upper arms 32F, 32R, 32F', 32R' and lower arms 34F, 34R, 34F', 34R' are biased in opposite directions by the first and second legs 142, 144 of the torsion springs 120.

Figure 13:
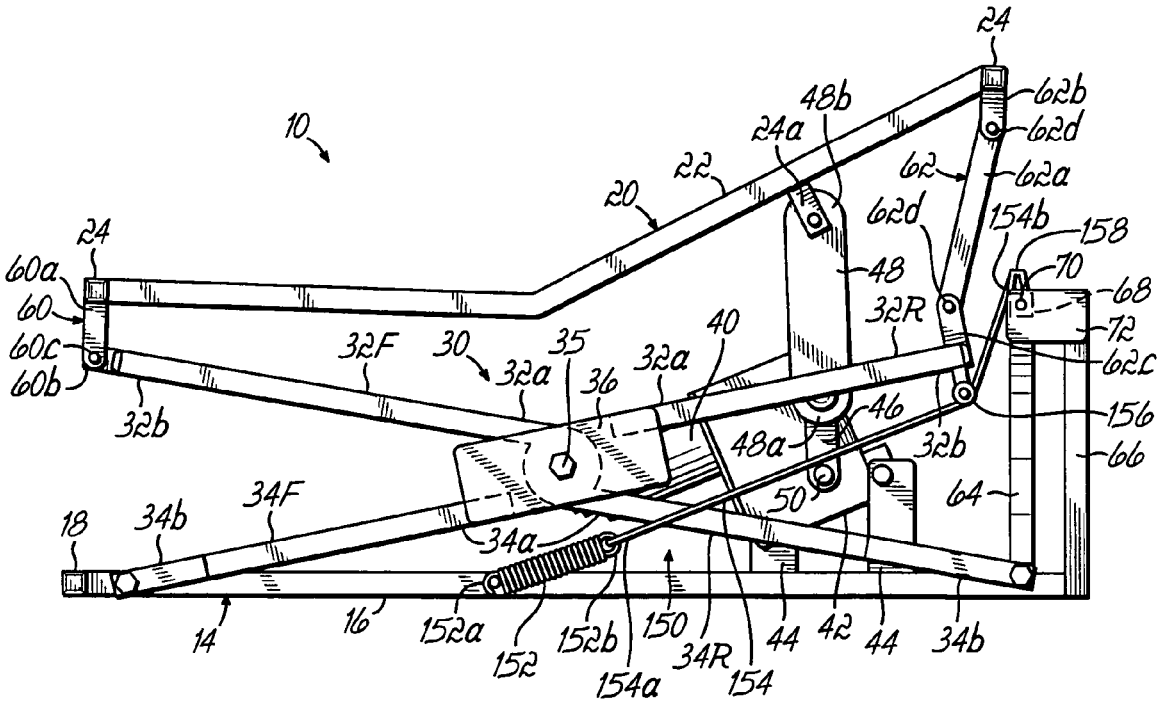
FIG. 13 is a side elevation of another alternate embodiment of the apparatus of FIG. 4.
Figure 14:
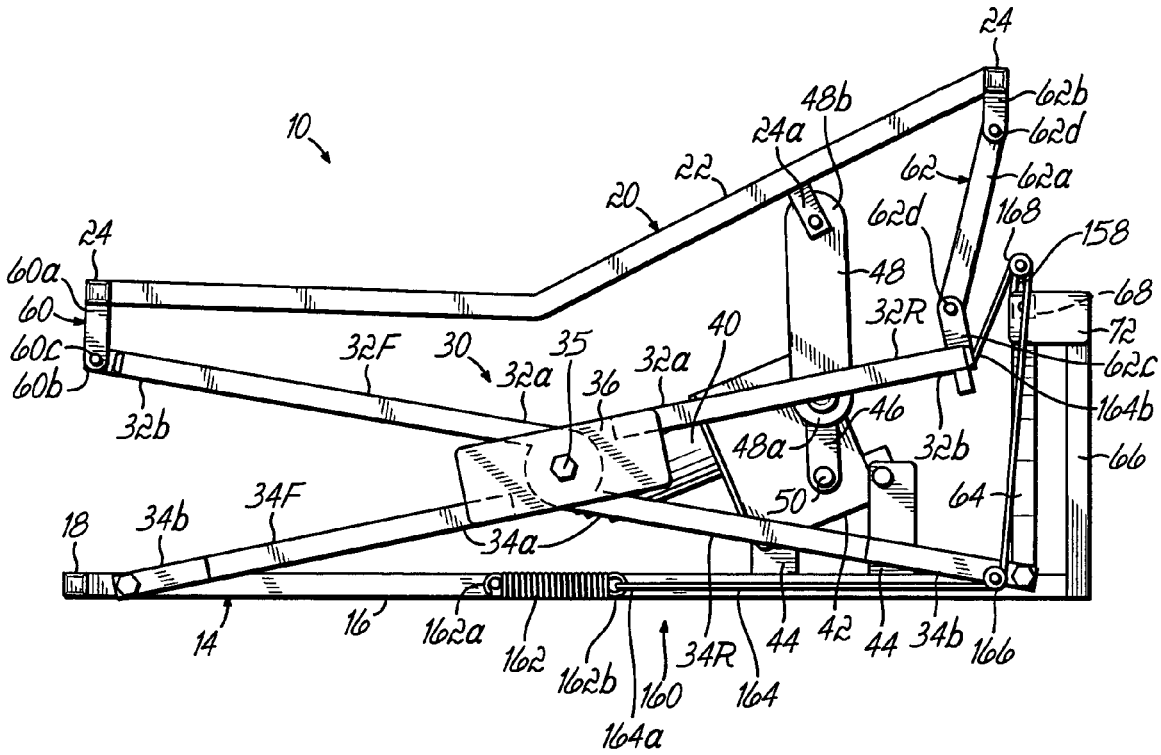
FIG. 14 is an alternate embodiment of the apparatus depicted in FIG. 13.

FIGS. 13 and 14 depict counterbalance mechanisms utilizing biasing members comprising spring and pulley systems. In FIG. 13, the apparatus 10 of FIG. 4 has been modified to include a counterbalance mechanism 150 comprising a tension spring 152 having a first end 152*a* coupled to frame 14, and a second end 152*b* coupled to the first end 154*a* of a cable 154. The cable 154 is routed through a pulley 156 fixed to the outer end 32*b* of the rear upper arm 32R of the scissor mechanism 30 and is secured at its second end 154*b* to a support 158 secured to bracket 72 on vertical post 66. As motor 40 operates to raise receiving member 20, as described above, spring 152 applies a force through cable 154 and pulley 156 to urge scissor mechanism 30 toward an extended position.

FIG. 14 depicts a counterbalance mechanism 160, similar to counterbalance mechanism 150 in FIG. 13. Spring 162 has a first end 162*a* coupled to frame 14, and a second end 162*b* coupled to the first end 164*a* a cable 164. Cable 164 is routed through a first pulley 166 attached to frame 14 and a second pulley 168 attached to support 158 on bracket 72. The second end 164*b* of cable 164 is secured to the outer end 32*b* of the rear arm 32R of scissor mechanism 30, whereby spring 162 biases the scissor mechanism 30 toward an extended position to offset the static and dynamic loads of an infant and an infant support 12 on the receiving member 20.

Figure 15:
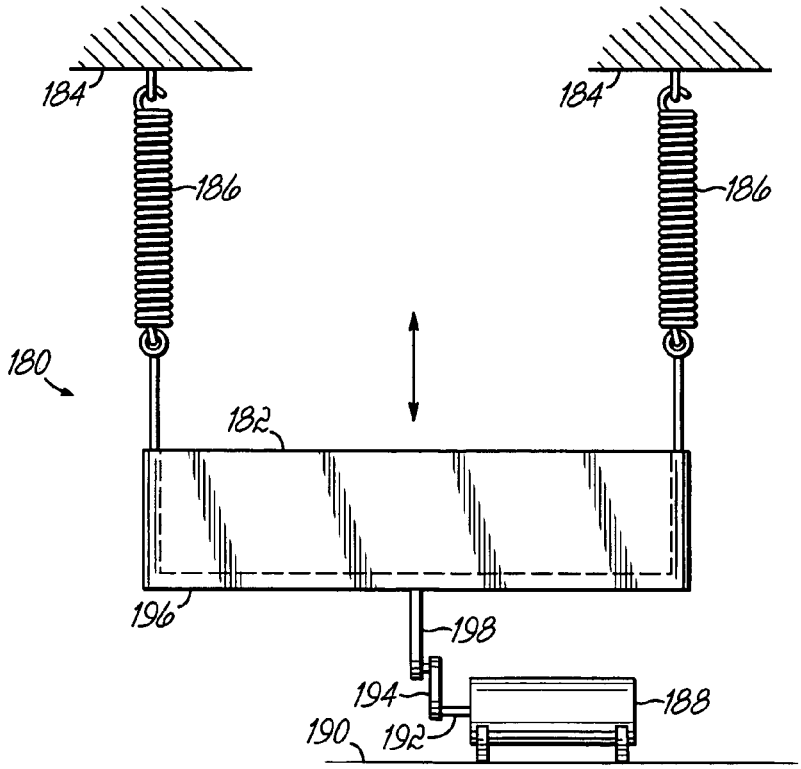
FIG. 15 is a side elevation depicting another embodiment of an apparatus for reciprocating an infant support, in accordance with the present invention.

Referring now to FIG. 15, there is shown another embodiment of an apparatus 180 for reciprocating an infant support according to the present invention. In FIG. 15, a receiving member 182 comprises a bassinet-like structure configured to receive an infant support therein. Alternatively, receiving member 182 may be configured to receive an infant placed directly therein. The receiving member 182 is resiliently secured to an overhead support structure 184, such as a ceiling, a doorframe, or a stand or other movable frame, by tension springs 186 attached to the longitudinal ends of the receiving member 182. A motor 190 positioned on a support surface 190, such as a floor, has an output shaft 192 and a crank arm 194 coupled to the bottom 196 of the receiving member 182 by a linkage 198, whereby the motor, cooperating with springs 186, reciprocates the receiving member 182 in a substantially vertical direction with a displacement in the range of approximately 2 to 6 inches at a frequency in the range of approximately 30 to 90 cycles per minute, as described above.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. An apparatus for reciprocating an infant support, the apparatus comprising:

a frame;

a receiving member configured to receive the infant support, said receiving member movable relative to said frame for reciprocation in a substantially vertical direction; and a motive device coupled to said receiving member and configured to reciprocate said receiving member relative to said frame with a displacement in the range of approximately 2 inches to approximately 6 inches at a frequency in the range of approximately 30 cycles per minute to approximately 90 cycles per minute.

2. The apparatus of claim 1, wherein said motive device is configured to reciprocate said receiving member relative to said frame with a displacement in the range of approximately 3 inches to approximately 5 inches.

3. The apparatus of claim 1, wherein said motive device is configured to reciprocate said receiving member relative to said frame with a displacement of approximately 4 inches.

4. The apparatus of claim 1, wherein said motive device is configured to reciprocate said receiving member relative to said frame at a frequency in the range of approximately 30 cycles per minute to approximately 60 cycles per minute.

5. The apparatus of claim 1, wherein said motive device is configured to reciprocate said receiving member relative to said frame at a frequency in the range of approximately 35 cycles per minute to approximately 70 cycles per minute.

6. The apparatus of claim 1, wherein said motive device is configured to reciprocate said receiving member relative to said frame at a frequency in the range of approximately 40 cycles per minute to approximately 90 cycles per minute.

7. The apparatus of claim 1, wherein said motive device includes an electric motor.

8. The apparatus of claim 7, further comprising a battery electrically coupled to said electric motor.

9. The apparatus of claim 1, wherein said motive device comprises a spring-wound mechanism.

10. The apparatus of claim 1, further comprising a counterbalance mechanism operatively coupled to said motive device, said counterbalance mechanism configured to provide a substantially uniform load on said motive device while said motive device reciprocates said receiving member.

11. The apparatus of claim 10, wherein said counterbalance mechanism comprises a biasing member operatively coupled to said motive device.

12. The apparatus of claim 10, wherein said counterbalance mechanism comprises a biasing member operatively coupled to said receiving member.

13. The apparatus of claim 10, wherein said counterbalance mechanism is adjustable to accommodate different loads on the apparatus.

14. The apparatus of claim 1, further comprising a reciprocating assembly coupled to said receiving member and configured to constrain movement of said receiving member relative to said frame such that said infant support moves in a substantially vertical direction.

15. The apparatus of claim 14, wherein said reciprocating assembly comprises a scissor mechanism coupled between said frame and said receiving member.

16. The apparatus of claim 14, wherein said motive device comprises a motor having an output shaft coupled to said receiving member by a first crank member, whereby rotation of said first crank member about said output shaft reciprocates said receiving member.

17. The apparatus of claim 16, further comprising a counterbalance mechanism operatively coupled to said motor, said counterbalance mechanism configured to provide a substantially uniform load on said motor while said motor reciprocates said receiving member.

18. The apparatus of claim 17, wherein said counterbalance mechanism comprises:

a second crank member coupled to said output shaft; and a tension spring having a first end coupled to said frame and a second end coupled to said second crank member.

19. The apparatus of claim 17, wherein said counterbalance mechanism comprises:

a gear train having a first gear coupled to said output shaft of said motor and a second gear driven in response to rotation of said first gear; and a tension spring having a first end coupled to said frame and a second end coupled to said second gear and radially offset from a center of rotation of said second gear.

20. The apparatus of claim 17, wherein said counterbalance mechanism comprises:

a bell crank having first and second crank arms, said bell crank pivotally mounted to said frame for pivotal movement of said first and second crank arms about an axis perpendicular to said vertical direction; and a tension spring having a first end coupled to said first crank arm and a second end coupled to said frame;

said second crank arm of said bell crank engagable with said receiving member whereby said tension spring biases said second crank arm to facilitate reciprocating movement of said receiving member in said vertical direction.

21. The apparatus of claim 17, wherein said counterbalance mechanism comprises:

a cable and pulley system coupled between said frame and said reciprocating assembly; and a spring having a first end coupled to said frame and a second end coupled to said cable and pulley system.

22. The apparatus of claim 16, further comprising:

a bell crank having first and second crank arms, said bell crank pivotally connected to said frame for pivotal movement of said first and second crank arms;

said first crank arm operatively coupled to said first crank member;

said second crank arm operatively coupled to said receiving member; and wherein said output shaft of said motor extends in a direction substantially parallel to said vertical direction, such that rotation of said first crank member about said output shaft pivots said first and second crank arms of said bell crank to thereby reciprocate said receiving member.

23. An apparatus for reciprocating an infant support, the apparatus comprising:

a frame;

a receiving member configured to receive the infant support, said receiving member movable relative to said frame for reciprocation in a substantially vertical direction;

a reciprocating assembly coupled to said receiving member and configured to constrain movement of said receiving member relative to said frame such that said infant support moves in a substantially vertical direction;

an electric motor coupled to said receiving member and configured to reciprocate said receiving member relative to said frame with a displacement in the range of approximately 2 inches to approximately 6 inches at a frequency in the range of approximately 30 cycles per minute to approximately 90 cycles per minute; and a counterbalance mechanism operatively coupled to said electric motor, said counterbalance mechanism configured to provide a substantially uniform load on said electric motor while said electric motor reciprocates said receiving member.

* * * * *

UNITED STATES PATENT AND TRADEMARK OFFICE

CERTIFICATE OF CORRECTION

PATENT NO. : 6,966,082 B2 
APPLICATION NO. : 10/700611
DATED : November 22, 2005
INVENTOR(S) : Bloemer et al.

It is certified that error appears in the above-identified patent and that said Letters Patent is hereby corrected as shown below:

Title page,
Item [73], Assignee, reads "...Westerkemp," and should read -- ...Westerkamp, --.

Column 4,
Line 20, reads "...in a substantially vertically direction..." and should read -- ...in a substantially vertical direction… --.

Column 5,
Line 39, reads "...such as a an infant seat,..." and should read -- ...such as an infant seat,… --.

Column 8,
Line 36, reads "...and lower arms 34F 34R, 34F', 34R' of..." and should read -- ...34F, 34R, 34F', 34R' of… --.
Line 60, reads "...first end 164a a cable 164." and should read -- ...first end 164a of cable 164. --.

Column 9,
Lines 11-12, reads "A motor 190 positioned on a support surface 190,..." and should read -- A motor 188 positioned on a support surface 190,... --.

Signed and Sealed this

Eleventh Day of July, 2006

JON W. DUDAS
*Director of the United States Patent and Trademark Office*